United States Patent [19]

Ghionda

[11] 3,975,871

[45] Aug. 24, 1976

[54] DWELLING WITH PLURAL LEVELS AND STORED FURNITURE

[76] Inventor: Andre Ghionda, 43 Avenue Mendiguren, 06 Nice, France

[22] Filed: June 20, 1975

[21] Appl. No.: 588,879

[30] Foreign Application Priority Data

June 20, 1974 France ..... 74.22170
Dec. 12, 1974 France ..... 74.41702

[52] U.S. Cl. ..... 52/36; 52/64; 5/10 R; 5/24

[51] Int. Cl.[2] ..... A47C 17/26

[58] Field of Search ..... 52/29, 32, 36, 64; 5/10 R, 24, 25, 26, 133, 136; 297/1, 3; 108/11, 12, 48

[56] References Cited

UNITED STATES PATENTS 3,337,879 8/1967 Humphrey ..... 5/24

FOREIGN PATENTS OR APPLICATIONS 369,879 9/1906 France ..... 52/10

*Primary Examiner*—John E. Murtagh
*Attorney, Agent, or Firm*—Young & Thompson

[57] ABSTRACT

A dwelling such as a ski cabin is provided with hide-away beds for conserving space. The beds are mounted on floor sections that pivot about medial horizontal axes, between a position in which the bed is lowermost and the floor unimpeded, and a position in which the bed is uppermost for use. Releasable locks are provided for releasably securing the bed in either of these positions. A night table is similarly vertically swingable between operative and hidden positions. The beds are mounted in elevated floors; and double doors are provided for access to the dwelling, which doors are so constructed as to serve also as storage closets for skis or the like.

10 Claims, 11 Drawing Figures

Fig. 3
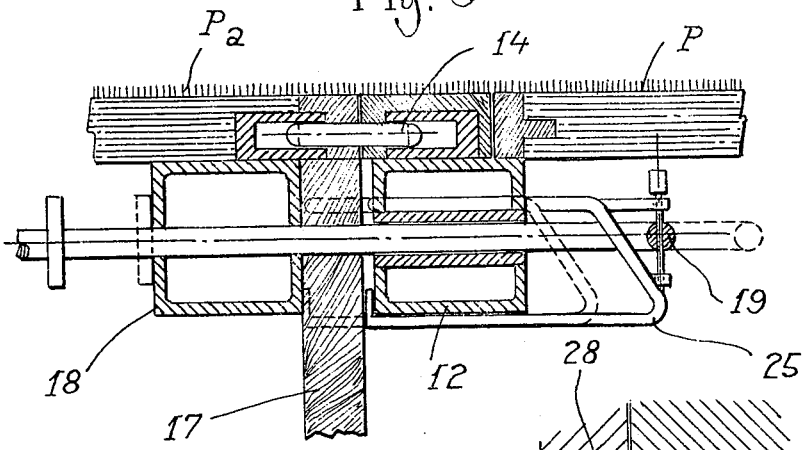
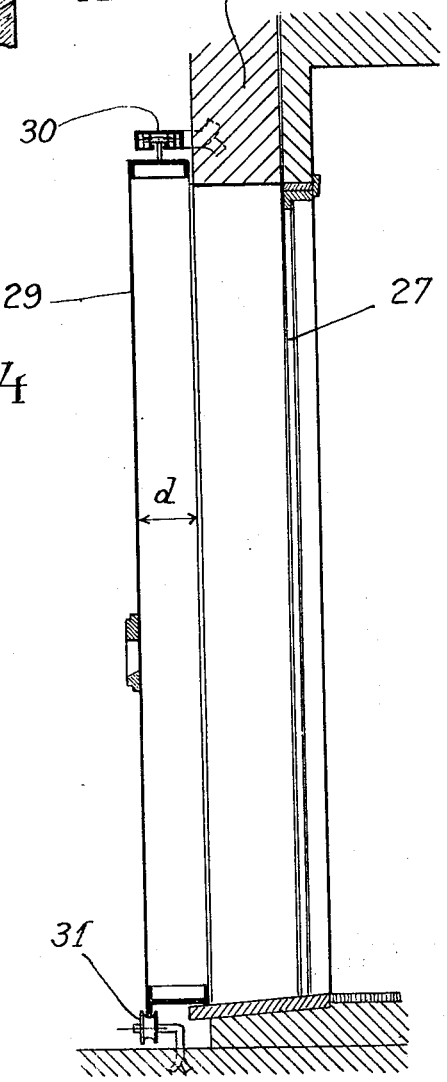
Fig. 4

18
12
17
16
S
14
19
12
15

DWELLING WITH PLURAL LEVELS AND STORED FURNITURE

The present invention concerns a dwelling with plural levels and stored furniture, the furniture being retrievable from storage for use as required.

It is an object of the present invention to provide such a dwelling, in which furniture may be readily stored and retrieved from use, so that when the furniture is stored additional living space will be available.

Another object of the present invention is the provision of such a dwelling with stored furniture, which will be relatively simple and inexpensive to construct, easy to operate, and rugged and durable in use.

Briefly, the objects of the present invention are achieved, by providing a dwelling with a raised floor beneath which are stored the articles of furniture when not in use, and from which the articles of furniture may be quickly and easily retrieved for use. One means by which this may be done according to the present invention is to provide vertically swinging trap door arrangements in the raised flooring, with linkage means for swinging the trap doors to bring furniture such as beds into operative position in one direction of operation and to store the same in the other direction of operation.

The invention also comprises a double door arrangement, in which the inner door is of known type while the outer door is slidably mounted and provides with the inner door a storage closet.

These and other objects, features and advantages of the present invention will become apparent from a consideration of the following description, taken in connection with the accompanying drawings, in which:

FIG. 3 is an enlarged cross-sectional view of pivotal mechanism for a bed mounted according to the present invention;

FIG. 4 is a cross-sectional view of a door of a dwelling according to the present invention, illustrating its storage capability;

Figure 1:
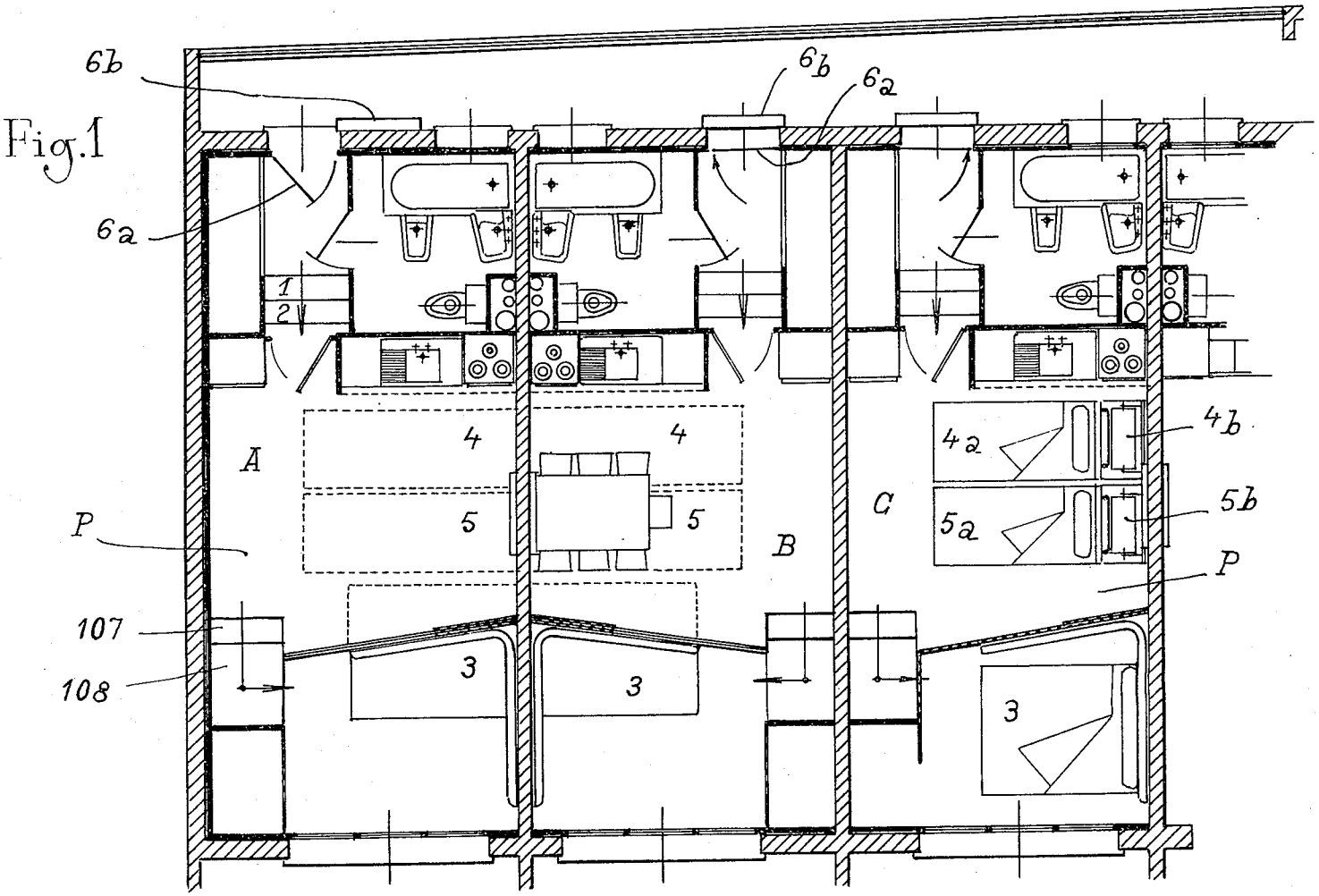
FIG. 1 is a plan view of a habitation according to the present invention.

Referring now to the drawings in greater detail, and first to FIG. 1, there is shown in plan a dwelling according to the present invention, provided with rooms A and B and a raised floor P, which one reaches by mounting the stairs 1, 2. Beneath the floor P are movably mounted a sofa bed 3 and two single beds 4, 5.

Entering the double doors 6a and 6b, which between them provide a closet for example for the storage of skis and simultaneously serve as a storm door, one reaches the ground level or lower level of the dwelling. Mounting the stairs 1, 2, one reaches the elevated level of floor P, which may for example be at an elevation of about 20 inches. Stairs 107, 108 lead down again to the floor level on which the sofa bed 3 is mounted for horizontal sliding movement between a position in which it is at least partially disposed beneath floor P, so as to provide a maximum of unimpeded floor space, and a position in which it is entirely out from under floor P, in which position it serves as a double bed.

Similarly, the beds 4, 5 are mounted for vertical swinging movement between the position shown in rooms A and B in FIG. 1, in which they are beneath the floor, and the position shown in room C in which the beds 4*a*, 5*a* are ready for use as such, and are supplemented by night tables 4*b*, 5*b*.

Figure 2:
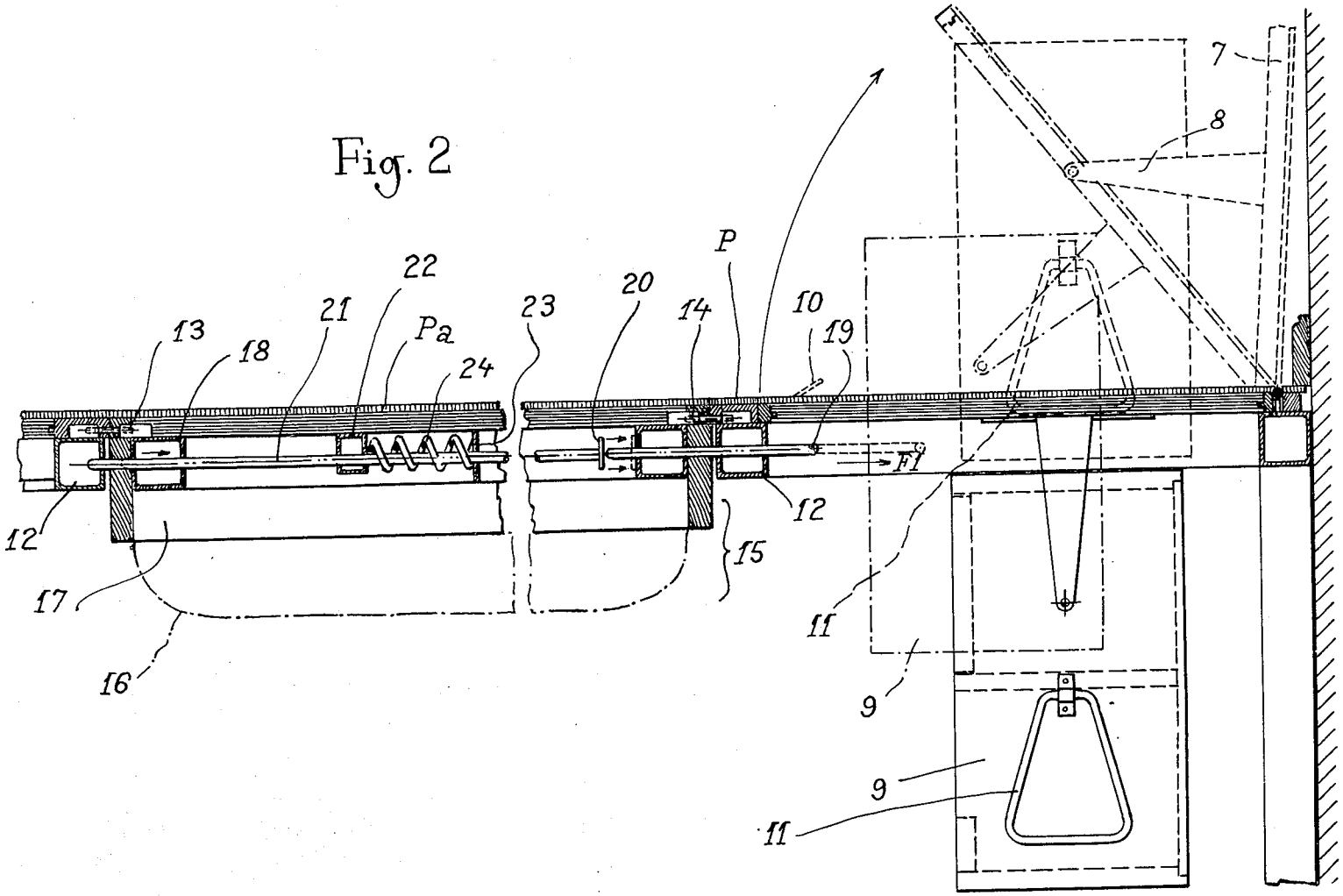
FIG. 2 is an enlarged cross-sectional view of structure at the head of a bed forming a part of the present invention.

FIG. 2 shows on a larger scale a cross section of the swinging mechanism of a bed and associated night table. A vertically swinging portion 7 of the floor, which is shown closed in rooms A and B of FIG. 1, is raised by means of a ring 10 recessed in the floor and pulls up, by means of the levers 8, a night table 9, as shown in full and phantom lines at the right of FIG. 2. It is of course to be understood that there is a lever 8 on each side of the night table 9 and that the night table 9 in its raised phantom line position of FIG. 2 is in operative condition and need not be turned in any direction. Instead, props 11, one on each side of table 9, swing out and rest against the adjacent portions of the floor to prevent table 9 from sinking again under its own weight. Needless to point out, the night table is lowered simply by pushing in the props 11 and lowering the floor portion 7. It will also be understood that the raising of floor portion 7 also exposes the mechanism for rotating the adjacent bed, from the inactive position shown in FIG. 2, to an active position.

Figure 5:
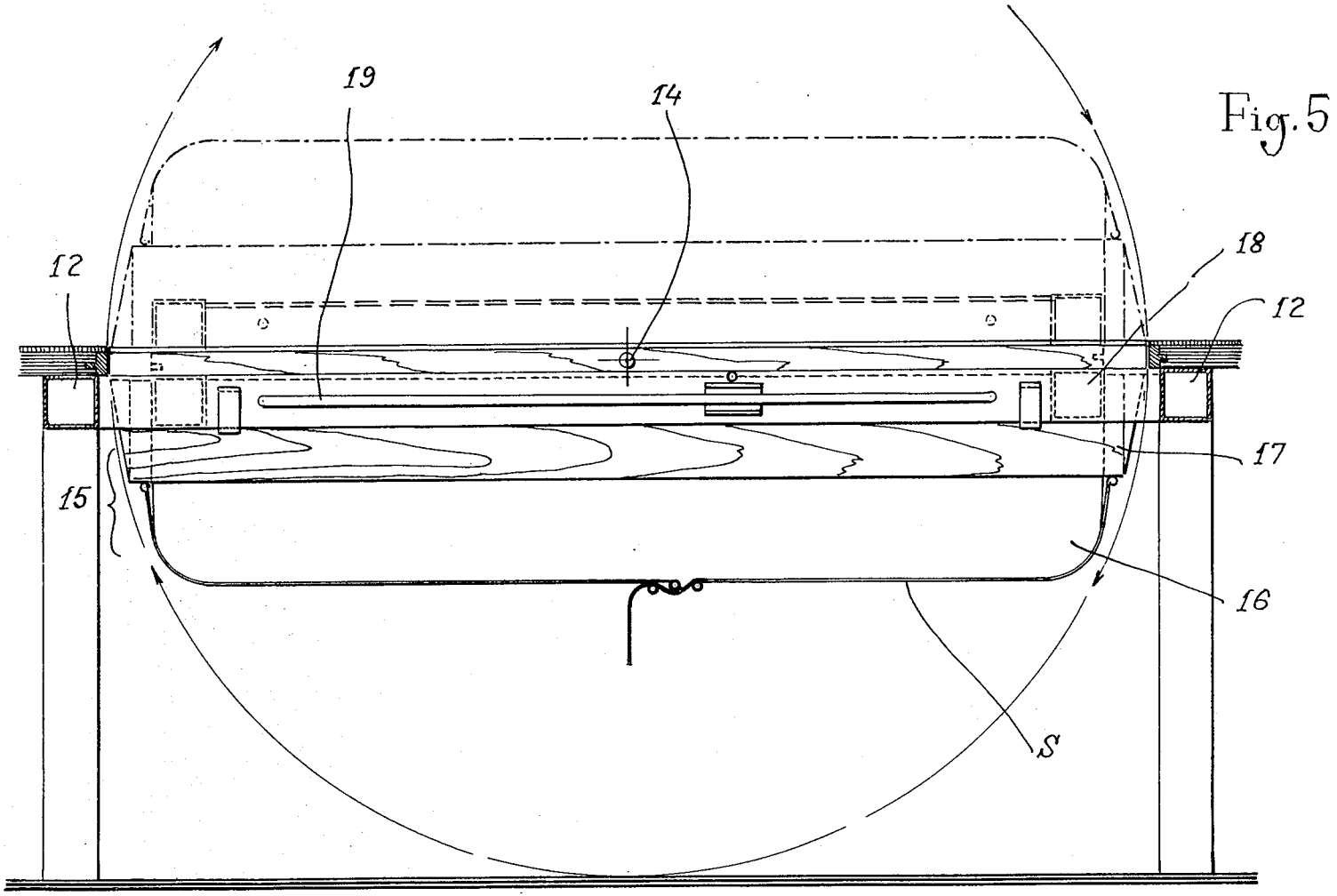
FIG. 5 is a cross-sectional view of a rotatably mounted bed forming a part of the present invention.

Each rotatable bed comprises a fixed rectangular frame 12 secured beneath the floor P, and supporting two aligned axles 13 and 14 about which the bed swings vertically about its longitudinal midline. The undersurface of the bed, when the bed is in use, is a floor portion $P_a$ that is flush with the rest of the floor P in the FIG. 2 position. The bed 15 proper, with its mattress 16 and frame 17, is bordered by a rectangular chassis 18 which is secured to the underside of floor portion $P_a$. A handle 19, accessible when the night table 9 is raised, operates locking rods for releasably securing the frames 12 and 18 together in the FIG. 2 position thereby to prevent rotation of the bed. To this end, the rod secured to handle 19 may for example be U-shaped, the two legs of the U coming into contact with heads 20 on rods 21 that slide through subframe 22 and have secured to them members 23. Coil compression springs 24 act between members 22 and 23 to urge rods 21 to the right as seen in FIG. 2, so that upon withdrawal of handle 19 in the direction of arrow $F_1$ in FIG. 2, not only will the legs of the U operated by the handle 19 be withdrawn from the frames 17 and 18, but also the heads 20 will come into abutment against the frame 18 thereby withdrawing the rods 21 from frame 12, after which the floor portion $P_a$ is free to swing vertically in the manner shown in FIG. 5. The strap S maintains mattress 16 in place when the bed is inverted; while retainer rods 25 or the like can be provided in association with the subfloor frames and rods, releasably to retain floor portion $P_a$ against swinging movement about axles 13 and 14 when the bed is in use. Of course, any suitable means for securing the bed in operative position relative to the remainder of floor P, can be employed.

Turning now to FIG. 4, the door structure of the present invention will be noted, which serves both as a storm door and as a storage place or closet for articles such as skis. The eminent suitability of a dwelling as in the present invention, for use for example as a ski cabin will therefore be apparent.

The door of the present invention is double and comprises a first panel 27 on the inner side which opens either by sliding movement, or, as shown in the drawings, by horizontal swinging movement about conventional hinges (not shown). On the outer door frame 28 there is another door panel 29, in the form of a hollow metal frame, which may for example be open on its inner side, and that carries on its upper edge wheels rotatable about vertical axes and that run in a downwardly opening slideway 30, and that has along its lower edge a downwardly directed flange that rolls on wheels 31 that are rotatable about horizontal axes. The panel 29 thus has a depth *d* which is available for the storage of items such as skis; although of course it is understood that the skis must not project beyond the profile of panel 29 least they prevent the opening of the door.

Figure 6:
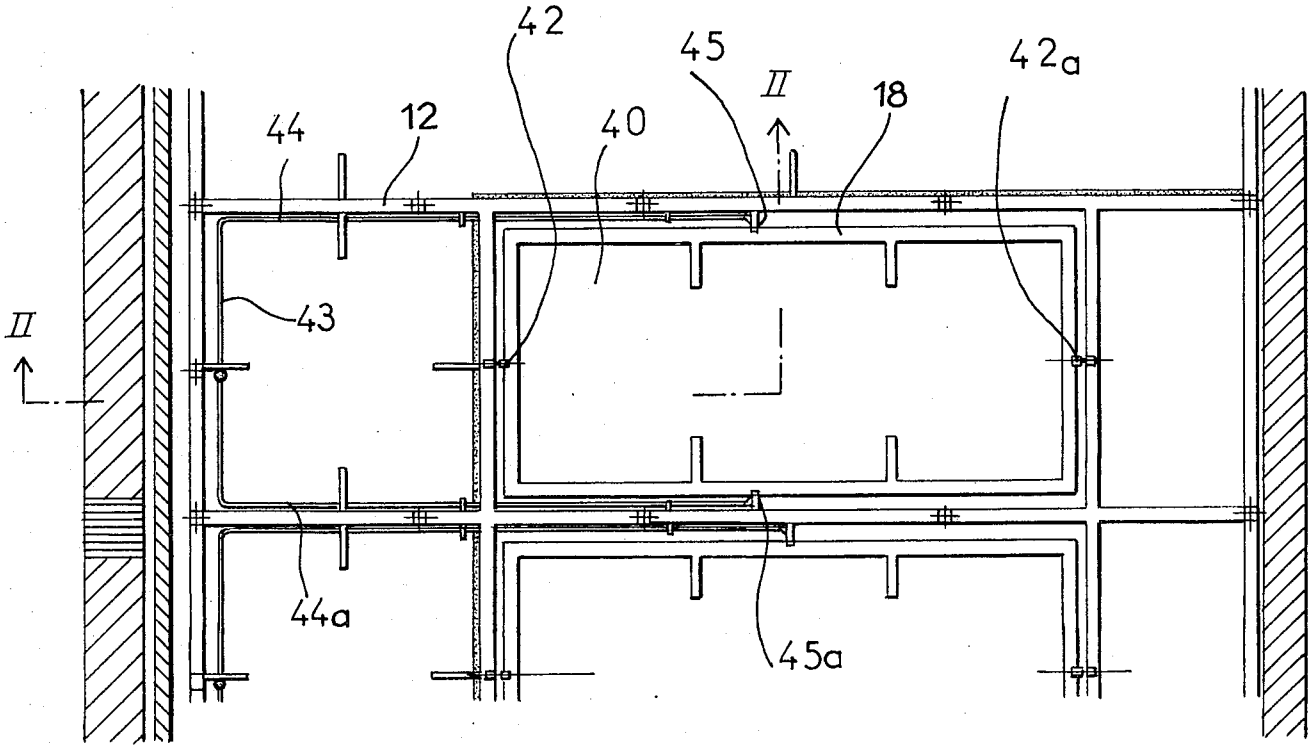
FIGS. 6–11 show other embodiments of means for swingably mounting beds in dwellings according to the present invention.
Figure 9:
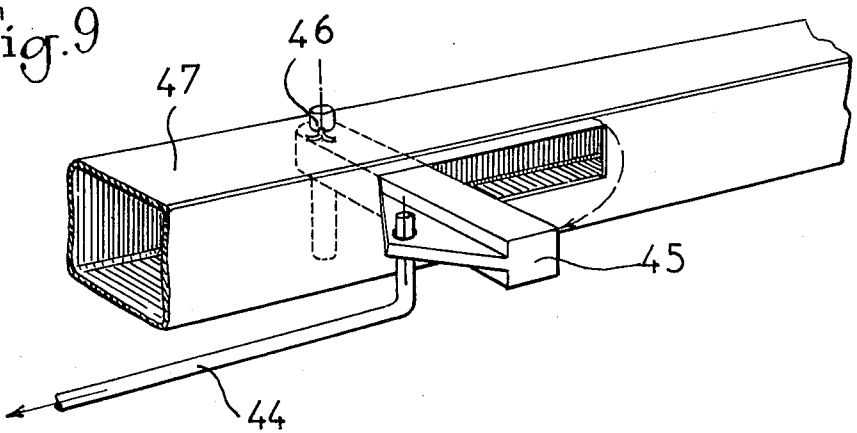
Figure 7:
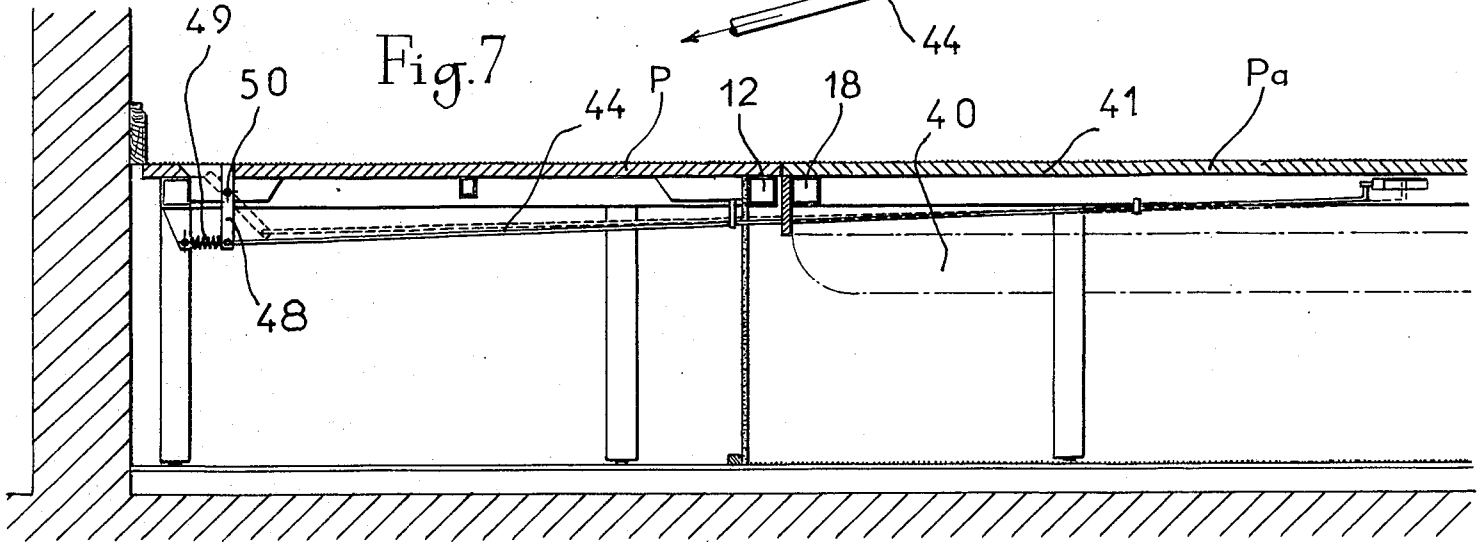

FIGS. 6–11 illustrate various alternative embodiments of the swinging bed structure. FIGS. 6 and 7 are respectively plan and side cross-sectional views of a swinging bed structure having a floor portion 41 and a bed 40 mounted thereon, FIG. 6 showing the flooring P, Pa removed and FIG. 7 being a section on the line II—II of FIG. 6. The bed turns about axles 42, $42_a$ which are midway of the length of the short sides of the bed. A transverse member 43 with two lateral legs 44, 44*a* controls the locking and unlocking of the swinging bed. The legs 44, 44*a* are secured at their ends to latches 45 that turn about axles 46 as shown in FIG. 9 so as either to be retractable into the hollow beam 47 or to project therefrom to block vertical swinging movement of the bed.

Figure 8:
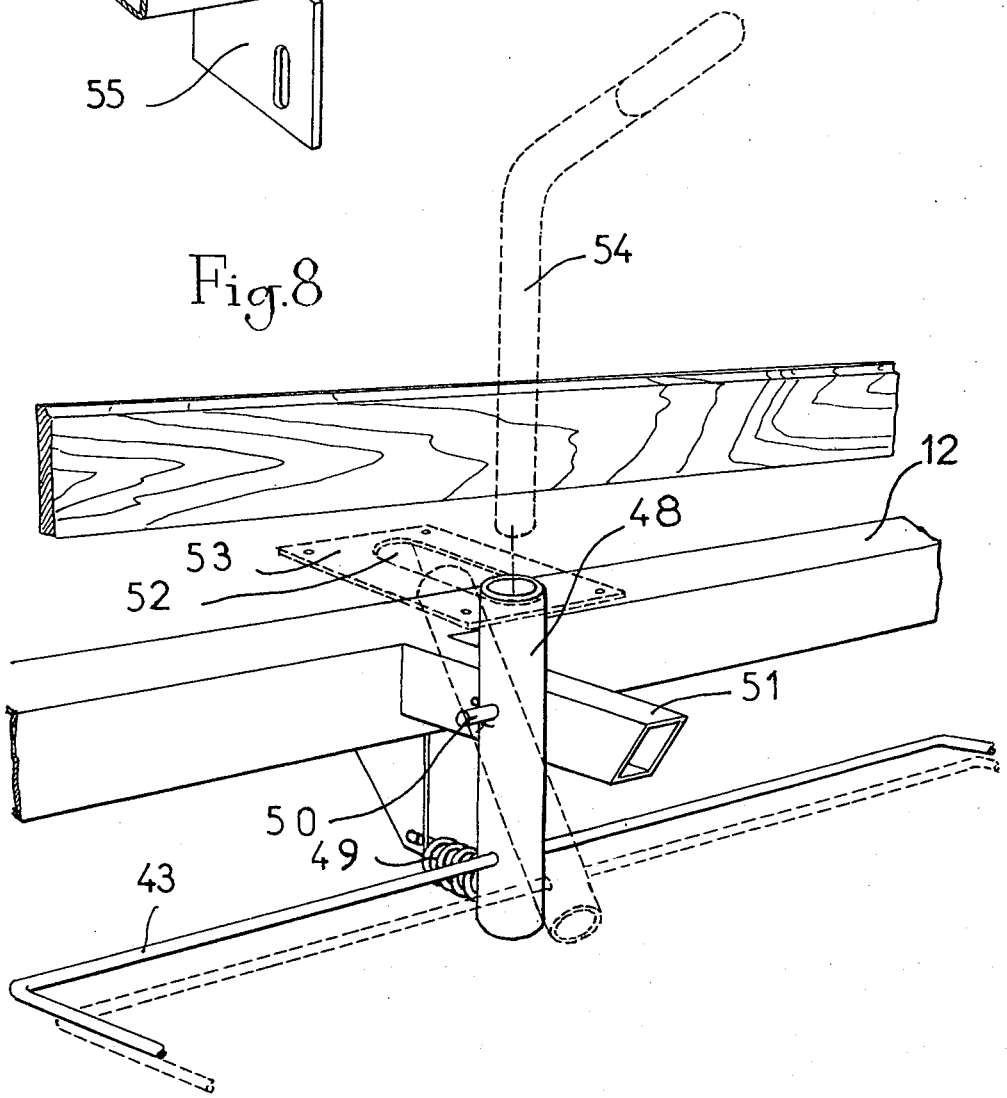

The manipulation of the U-shaped member 43, 44, 44*a* is shown at the left of FIG. 7 and in FIG. 8. Member 43 passes through a hole in a hollow cylindrical lever 48 that is urged by a coil tension spring 49 clockwise about a pivot 50 as seen in FIGS. 7 and 8, on a hollow beam 51 of the floor frame 12. Lever 48 may be swung in a slot 52 in a guide plate 53 by means of a removable key or handle 54 engaged in the hollow center of lever 48. Thus when key or handle 54 is inserted in lever 48 and lever 48 is swung against the action of spring 49 from the full line to the phantom line position in FIGS. 7 and 8, the rod 43 with its legs 44, 44*a* is temporarily pushed from the full line to the phantom line position in FIGS. 7 and 8, thereby releasing the bed frame 18 for vertical swinging movement in the manner previously described in connection with FIGS. 2, 3 and 5; while when the layer 48 is released, the spring 49 returns it from the phantom line to the full line position and the bed is again locked against vertical swinging movement. It its operative position, that is, bed side up, the bed of FIGS. 6–9 may be secured against vertical swinging movement by any desired means, such as those previously described, or others which will be obvious to persons ordinarily skilled in this art.

It will of course be appreciated that the operation of the bed release mechanism by means of a removable key or lever 54 makes it difficult for unauthorized persons to tamper with the mechanism.

Figure 10:
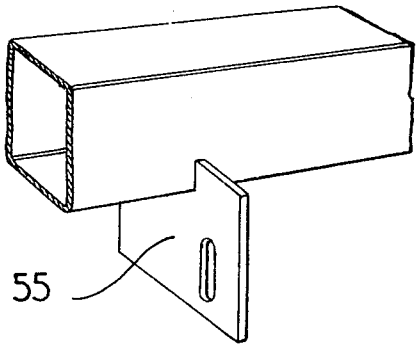
Figure 11:
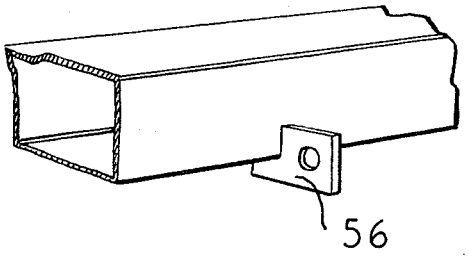

FIGS. 10 and 11 show the provision of guide plates 55, 56 on the frame beams, for the guidance of legs 44 while permitting limited vertical movement thereof.

From a consideration of the foregoing disclosure, therefore, it will be evident that the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A dwelling having several levels and including a raised floor, means mounting a portion of the raised floor for rotation about a horizontal axis, a bed on one side of said floor portion, and means for releasably retaining said floor portion against rotation.

2. A dwelling as claimed in claim 1, and a double door providing access to the dwelling, one of the doors being mounted for sliding movement parallel to a wall of the dwelling in which the door is disposed.

3. A dwelling as claimed in claim 2, said sliding panel being hollow and opening inwardly of the dwelling, and rollers mounting the panel for horizontal sliding movement on and relative to said wall of the dwelling.

4. A dwelling as claimed in claim 1, and a night table at the head of said bed, means mounting the night table for vertical swinging movement through an opening in said raised floor, and a trap door mounted for vertical swinging movement and closing said opening flush with the floor and when raised exposing said opening and said means mounting said bed for vertical swinging movement.

5. A dwelling as claimed in claim 1, and a bed slidable in one direction at least partly beneath said raised floor and slidable in the opposite direction horizontally entirely out from beneath said raised floor to constitute a further bed.

6. A floor and bed assembly comprising a floor having a portion mounted for vertical swinging movement about a horizontal axis, a bed on one side of said floor portion, and means carried by the floor adjacent said floor portion and movable selectively into and out of engagement with said floor portion thereby selectively to secure and release said floor portion.

7. An assembly as claimed in claim 6, said horizontal axis bisecting said floor portion.

8. An assembly as claimed in claim 6, said movable means comprising a U-shaped member having two legs and a central portion, said two legs being selectively engageable with said floor portion and slidable in a fixed portion of said floor.

9. An assembly as claimed in claim 8, said legs being slidable lengthwise into and out of engagement with said swingable floor portion.

10. An assembly as claimed in claim 8, said legs being pivotally connected to and carried by said fixed floor portion to swing into and out of engagement with said swingable floor portion.

* * * * *